US005460224A

United States Patent [19]

Schalla et al.

[11] Patent Number: 5,460,224

[45] Date of Patent: Oct. 24, 1995

[54] WELL PURGE AND SAMPLE APPARATUS AND METHOD

[75] Inventors: Ronald Schalla, Kennewick; Ronald M. Smith, Richland; Stephen H. Hall, Kennewick; John E. Smart, Richland; Gregg S. Gustafson, Redmond, all of Wash.

[73] Assignee: Battelle Memorial Institute, Richland, Wash.

[21] Appl. No.: 112,829

[22] Filed: Aug. 26, 1993

[51] Int. Cl.[6] ..... E21B 49/08

[52] U.S. Cl. ..... 166/264; 166/106; 166/169

[58] Field of Search ..... 166/264, 169, 166/167, 106; 73/155

[56] References Cited

U.S. PATENT DOCUMENTS

| | | | |
|---|---|---|---|
| 2,511,759 | 6/1950 | Williams | 166/106 X |
| 2,781,663 | 2/1957 | Maly et al. | 166/264 X |
| 3,104,713 | 9/1963 | Lebourg | 166/169 X |
| 4,538,683 | 9/1985 | Chulick | 166/264 |
| 4,573,532 | 3/1986 | Blake | 166/264 |
| 4,635,717 | 1/1987 | Jageler | 166/264 X |
| 4,717,473 | 1/1988 | Burge et al. | 166/264 X |
| 4,745,801 | 5/1988 | Luzier | 73/155 |
| 5,293,931 | 3/1994 | Nichols et al. | 166/264 X |
| 5,293,934 | 3/1994 | Burge et al. | 166/264 X |

*Primary Examiner*—Hoang C. Dang
*Attorney, Agent, or Firm*—Paul W. Zimmerman

[57] ABSTRACT

The present invention specifically permits purging and/or sampling of a well but only removing, at most, about 25% of the fluid volume compared to conventional methods and, at a minimum, removing none of the fluid volume from the well.

The invention is an isolation assembly with a packer, pump and exhaust, that is inserted into the well. The isolation assembly is designed so that only a volume of fluid between the outside diameter of the isolation assembly and the inside diameter of the well over a fluid column height from the bottom of the well to the top of the active portion (lower annulus) is removed. The packer is positioned above the active portion thereby sealing the well and preventing any mixing or contamination of inlet fluid with fluid above the packer. Ports in the wall of the isolation assembly permit purging and sampling of the lower annulus along the height of the active portion.

13 Claims, 8 Drawing Sheets

WELL PURGE AND SAMPLE APPARATUS AND METHOD

This invention was made with Government support under Contract DE-AC06-76RLO 1830 awarded by the U.S. Department of Energy. The Government has certain rights in the invention.

FIELD OF THE INVENTION

The present invention relates generally to an apparatus and method for obtaining well fluid from a well. More specifically, the invention is a method and apparatus for purging and/or sampling well fluid wherein the apparatus is an isolation assembly with a packer, pump means and exhaust direction means, that minimizes the amount of fluid discharged for purging and/or sampling.

BACKGROUND OF THE INVENTION

Sampling the contents of a well is commonly done for purposes ranging from bacterial analysis of potable water wells to chemical analysis of oil and gas supply wells. With increased environmental protection regulations, more sampling wells, particularly water wells, have been drilled.

Prior to sampling a well, the standing fluid must be removed or purged so that what is sampled is fresh fluid influx to the well rather than stagnant fluid. Because fluid extracted from a well may become contaminated, it is preferred to avoid re-injecting the fluid into the well. Moreover, if the fluid is already contaminated (hence the reason for taking the samples) it is preferred to contain the contamination and not spread it by dumping it on the ground. In the United States, extracted well fluid is prohibited by regulation from being re-injected into the well or dumped onto the ground. Hence, handling the volume of purged fluid adds significant expense to the sampling procedure and as more sampling is done, the cost rises proportionately.

Present methods of purging involve removing two to four well volumes into a container. If sampling must be done more than once, with extended period of time between sampling, the well must be purged prior to each sampling. Thus, there is a need in the well sampling industry for a means and method of purging and sampling that would reduce the amount of water taken from wells for purposes of sampling.

SUMMARY OF THE INVENTION

The present invention specifically permits purging and/or sampling of a well but only removing, at most, about 25% of the fluid volume compared to conventional methods and, at a minimum, removing none of the fluid volume from the well.

The invention is an isolation assembly with a packer, pump means and exhaust direction means, that is inserted into the well. The isolation assembly is designed so that only a volume of fluid between the outside diameter of the isolation assembly and the inside diameter of the well over a fluid column height from the bottom of the well to the top of the active portion (lower annulus) is removed. The packer is positioned above the active portion thereby sealing the well and preventing any mixing or contamination of inlet fluid with fluid above the packer. Because the top of the isolation assembly may be open and well fluid may enter therein but is prevented from entering the lower annulus, and although well fluid within the isolation assembly may literally be below the packer, the phrase "above the packer" or "above the sealing means" as used herein is defined to mean the same as "excluded from the lower annulus". In its broadest sense, that definition can include well fluid in an isolation chamber. Where an internal seal exists between the isolation chamber and the packer unit, the phrase "above the packer" does not include the isolation chamber.

Ports in the wall of the isolation assembly permit purging and sampling of the lower annulus along the height of the active portion.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

Figure 1:
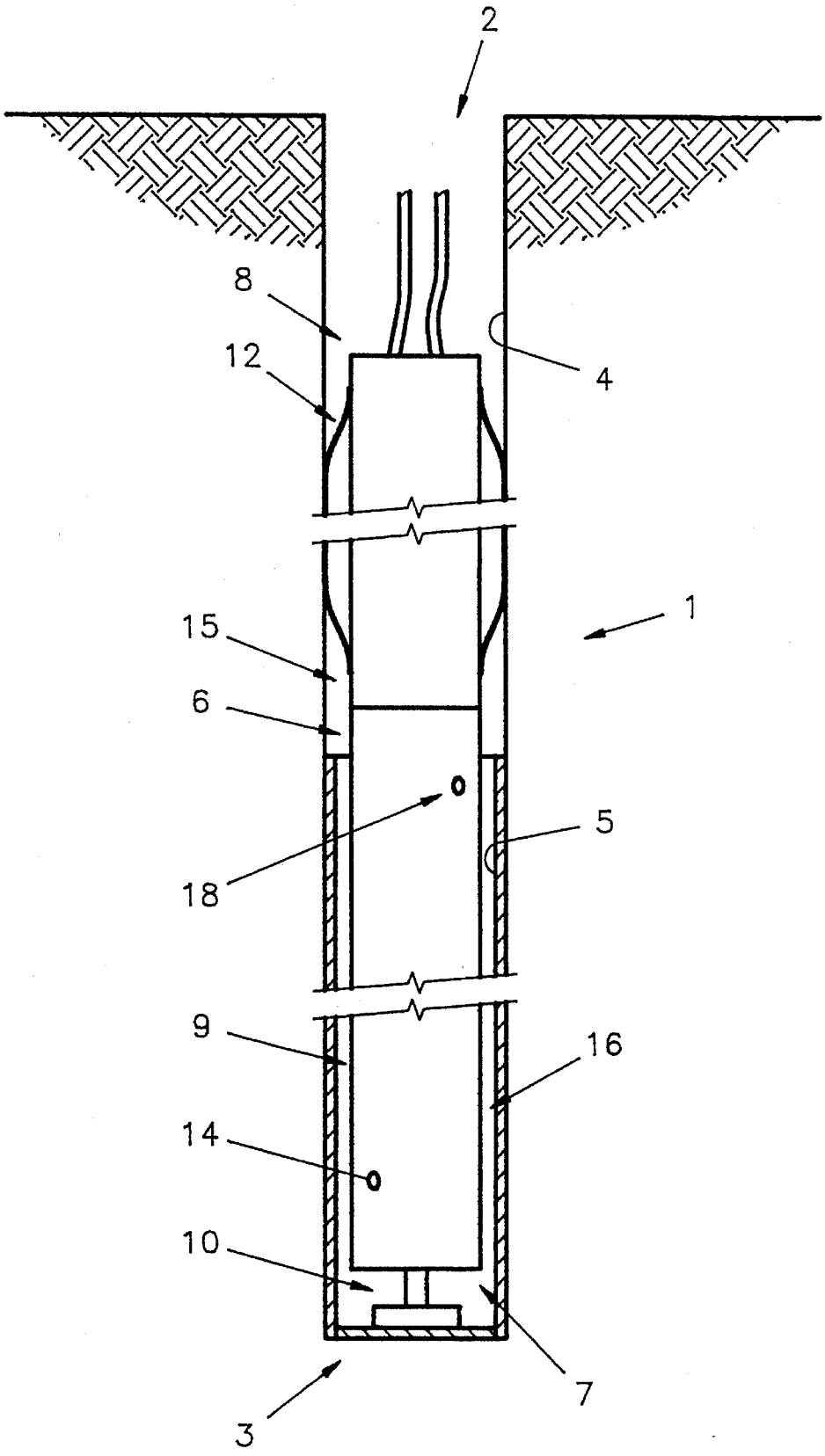
FIG. 1 is a section view of a well showing deployment of the isolation assembly.

Referring to FIG. 1., illustrated therein is a well 1 having a top opening 2, a bottom 3, an inner surface 4, and an active portion 5. The inner surface 4 may be earth, for example host rock or soil, or a casing of metal or plastic, and the active portion may be earth or a screened interval.

For purposes of purging and sampling, an isolation assembly 6 that is hollow and having a first end 7 and a second end 8 is inserted into the well 1 wherein the first end 7 is positioned near or in contact with the bottom 3 of the well 1 and the second end 8 extends above the active portion 5.

The isolation assembly 6 has an isolation chamber 9 with valve means 10 mounted at or near the first end 7 for admitting well fluid into the isolation chamber 9, sealing means 12 for sealing between the inner surface 4 and the isolation assembly 6, and at least one port 14 for admitting additional well fluid into the isolation assembly 6.

During insertion of the isolation assembly 6, the valve means 10 may permit well fluid to enter the isolation chamber 9. Upon locating the isolation assembly 6 in a final position in the well 1, the valve means 10 is closed and sealed thereby isolating the well fluid within the isolation chamber 9 thereby preventing mixing of fluid within the isolation chamber 9 with fluid in an annular space 15 between the isolation chamber 9 and the inner surface 4 of the well 1.

After insertion to the final position, sealing means 12 is activated for sealing the annular space 15. The sealing means 12 is mounted near the second end 8 and positioned above the active portion 5 thereby isolating well fluid in a lower annulus 16 from below the sealing means 12 to the bottom 3 of the well 1 from well fluid above the sealing means 12. (The lower annulus 16 includes volume between the first end 7 of the isolation assembly 6 and the bottom 3 of the well 1.) With the isolation assembly 6 in place, the volume of well fluid within the isolation chamber 9 need not be removed from the well 1 for purposes of purging. The volume of well fluid to be purged is that within the lower annulus 16.

In a well 1 having an inside diameter of 4.0 inches which would be the case for a nominal 4-inch schedule 40 casing, an isolation assembly 6 having an outside diameter of 3.5 inches results in a well fluid volume to be purged of about 23% of the total well volume assuming that the well fluid level is below the sealing means 12. If instead, the nominal 4-inch well has a schedule 80 casing, then the inside diameter is 3.826 inches and the 3.5 inch diameter isolation assembly 6 results in a well fluid volume to be purged of about 9% of the total well volume. If the well fluid level is above the sealing means 12, then there is further reduction in purge volume.

During purging or sampling at least one port 14 takes well fluid from the lower annulus 16. The purged or sampled well fluid may be discharged to the surface and handled accordingly. Alternatively, regulations permitting, purged or sampled well fluid may be discharged into the volume above the sealing means 12. In wells wherein the screened interval of the well has low permeability or that are located in an area regulations do not permit leaving the purged or sampled well fluid in the well, the purged or sampled well fluid may be discharged into a riser, preferably an expandable riser. Expandable risers are disposed of more easily and for less cost than the cost of disposal and decontamination of rigid risers. If a riser is not used, and well fluid removal is needed, well fluid above the sealing means 12 can be removed at a convenient time for disposal. In wells not needing or requiring removal of purged or sampled well fluid, the purged or sampled well fluid may simply flow back toward the bottom 3 of the well 1 upon release of the sealing means 12.

After purging and/or sampling, the isolation assembly 6 may be removed from the well 1. Removal is facilitated by a pressure equalization means 18 that permits valve means 10 to open and permit well fluid to drain from the isolation chamber 9.

ISOLATION ASSEMBLY

Figure 2:
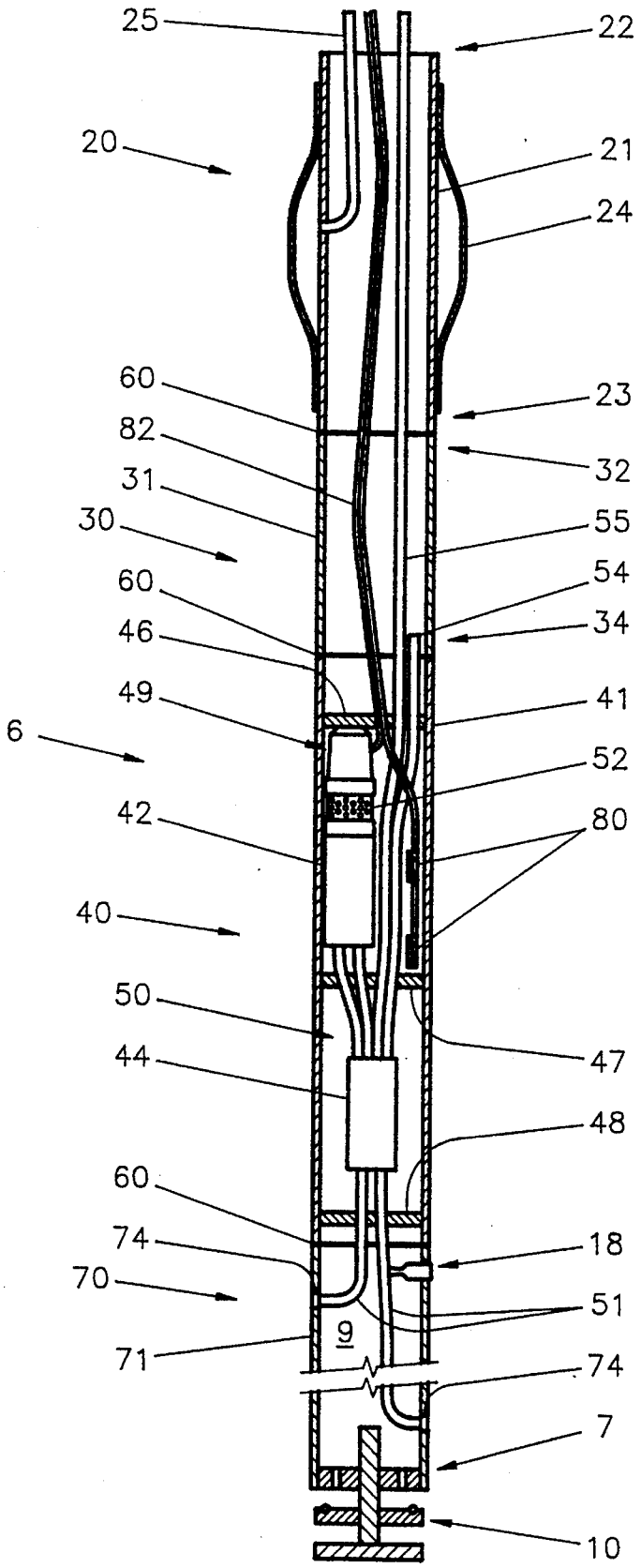
FIG. 2 is a section view of the isolation assembly.

In FIG. 2, further detail of the isolation assembly is provided. The isolation assembly 6 generally has four subsections, packer unit 20, spacer unit 30, operational unit 40, and isolation unit 70. Units are connected with coupling means 60, wherein the coupling means 60 is preferably a threaded coupling.

The packer unit 20 has a packer housing 21. The packer housing 21 may be made of any hollow material but is preferably schedule 80 polyvinyl-chloride (PVC) pipe. The packer housing 21 has an open end 22 and a coupling end 23. The coupling end 23 may be of any suitable geometry permitting connection with the spacer unit but preferably has a thread machined on the external surface of the coupling end 23. Mounted on the exterior of the packer housing 21 is a packer 24. The packer 24 may be any type of packer including but not limited to mechanical packers, fluid inflated packer, disposable packer or compression packer. Preferably, the packer 24 is a fluid inflated packer made of an elastomeric material. A packer inflation line 25 is provided.

The spacer unit 30 has a housing 31 with a first end 32 and a second end 34. The first end 32 connects with the coupling end 23. Thus, the first end 32 preferably has internal threads connectably compatible with the external threads on the coupling end 23. The second end 32 preferably has an external thread. While FIG. 2 shows a single spacer length, it will be appreciated by those skilled in the art that the spacer 30 may be of any length or may contain several lengths of housing 31 with connectable ends. The purpose of the spacer 30 is to place the packer 24 above the active portion 5 while the first end 7 of the isolation assembly 6 rests near or on the bottom 3 of the well 1.

The operational unit 40 has a housing 41 connectable to the spacer unit 30 preferably in the same manner as the spacer unit 30 connects to the packer unit 20. Within the operational unit 40, is a pump means 42 and exhaust direction means 44. Further, a top bulkhead 46, center bulkhead 47, and bottom bulkhead 48 are optionally used to seal a pump chamber 49, and an exhaust chamber 50. One or more inlet lines 51 direct well fluid from the lower annulus 16 to the exhaust direction means 44 and thence to the pump inlet 52. The pump means 42 exhausts back through the exhaust direction means 44 and thence either to a first exhaust port 54 or a second port 55. The first exhaust port 54 directs well fluid through the interior of the spacer and packer units 30 and 20 respectively and to the well volume above the packer 24. The second port 55 is a transport tube that directs well fluid to the top of the well 1.

The isolation unit 70 has a housing 71 with at least one end connectable with other units. It will be apparent to those of skill in the art that the isolation unit 70 may be of any length or have one or more isolation units 70 with both ends connectable thereby permitting locating one or more ports 74 at predetermined height(s) above the bottom 3 of the well 1. The isolation unit 70 resting near or on the bottom 3 of the well 1, has an end 7 with valve means 10. The isolation chamber 9 is defined by the interior space from below the bottom bulkhead 48 to above the valve means 10.

When an internal bulkhead is present, pressure equalization means 18 is provided in the isolation unit 70 near connection with the operational unit 40 so that upon release of the packer 24, the well fluid within the isolation chamber 9 would be able to drain through valve means 10 upon pressure equalization means breaching the water level within the well 1. Pressure equalization may be achieved by any means, but is preferably a float valve that opens when the float is in air above a well fluid level.

Sensors 80 for measuring well fluid characteristics could be mounted in any location within or without the isolation assembly 6. For example, they could be located on either the inlet side or exhaust side of the pump means 42 or within the isolation unit 70. Sensors 80 are however preferably mounted within the operational unit 40 in a manner permitting contact with well fluid prior to well fluid entry into the pump means 42. Placement of sensors within the operational unit 40 permits keeping all electrical wiring within a particular unit which simplifies manufacture, assembly, and operation. Placement of sensors prior to pump means inlet 52 avoids any sample interaction with the pump means 42.

An electrical bundle 82 is provided for providing electricity to the pump means 42, exhaust direction means 44, and the sensors The valve means 10 can be any valve means including but not limited to electrically actuated, pneumatically actuated, and mechanically actuated valves. It is preferred to use a mechanically actuated valve to eliminate the need to run a line, either electrical or fluidic, to the valve means 10 location.

VALVE MEANS

Figure 3:
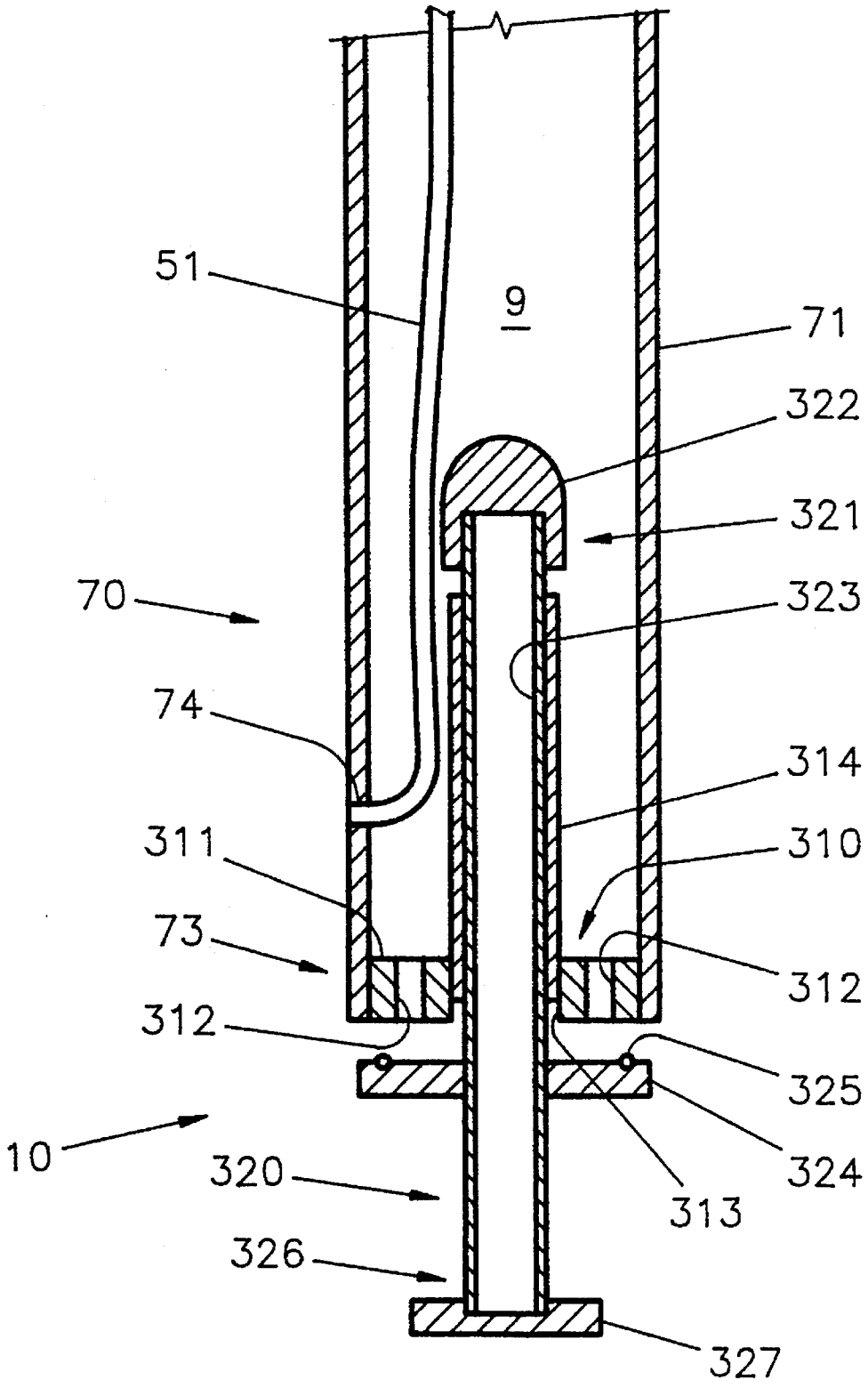
FIG. 3 is a section view of the valve means.

Further detail of a preferred embodiment of the valve means 10 is provided in FIG. 3. In this embodiment, valve means 10 has a sealable bulkhead 310 and a slidable stem 320. The sealable bulkhead 310 is connectable to the valve end 73 of housing 71 preferably threadably connectable with the valve end 73 with internal threads on the housing 71 valve end 73 and external threads on a bulkhead disk 311. The bulkhead disk 311 has at least one hole for flow of well fluid. In addition, a center hole has a guide tube 314 mounted therein.

The slidable stem 320 has a first end 321 with a cap 322 mounted thereon. An elongate section 323 extends from the first tube end 321 through the guide tube 314 and below the bulkhead disk 311. Below the bulkhead disk a sealing disk 324 is attached to the elongate section 323. An elastomeric ring 325 is mounted on the sealing disk 324 wherein the elastomeric ring 325 contacts the bulkhead disk 311 forming a seal and preventing flow of well fluid through hole(s) 312. The elongate section 323 further extends to a second tube end 326 having a closure disk 327 mounted thereon. The closure disk 327 prevent well fluid from entering the elongate section 323 and bears on the bottom 3 of the well 1. The cap 322 also prevents well fluid from entering the elongate section 323 and bears on the guide tube 314 thereby preventing the slidable stem 320 from falling through the sealable bulkhead 310.

It will be apparent to those skilled in the art that the valve means 10 can be made in many ways other than depicted in FIG. 3. For example, a hinge valve could be used instead of a slidable valve. Alternatively the sealable bulkhead 310 could be made to slide within the housing 71 past holes in the side of the housing 75. Further, a sealing disk 324 may be rigidly mounted within housing 71 with the elastomeric ring 325 on the downward facing side of the sealing disk 324. Holes would be added to the sealing disk 324 to permit flow of well fluid.

EXHAUST DIRECTION MEANS

It will be understood by those skilled in the art that the exhaust direction means 44 may be any combination of one-way and/or multi-way valves having any type of remote actuation. In the following description, an operative preferred embodiment is described in terms of solenoid actuated one-way valves connected by tubes. This operative preferred embodiment fits within the operation unit 40 using readily available solenoid valves and tubing. As a practical expedient, check valves 410 are included to prevent closed solenoid valves from being forced open by pump pressure.

However, exhaust direction means 44 may be constructed from a solid piece of material wherein flow passages are machined therein and threaded holes are provided for installation of solenoid valves. Yet further, the exhaust direction means 44 could be constructed as a large rotary valve or series of rotary valves wherein simply rotating a valve control stem to a particular location would provide the proper valve and flow passage arrangement for a particular direction function. Moreover, check valves are not necessary if valves are used having sufficient resistance to system pump pressure. It will be recognized that many modifications to the operative preferred embodiment are possible that perform essentially the same function of selectively drawing well fluid in essentially the same way of directing well fluid through tubing, valve(s), and pump means, to achieve essentially the same result of purging and/or sampling.

Figure 4:
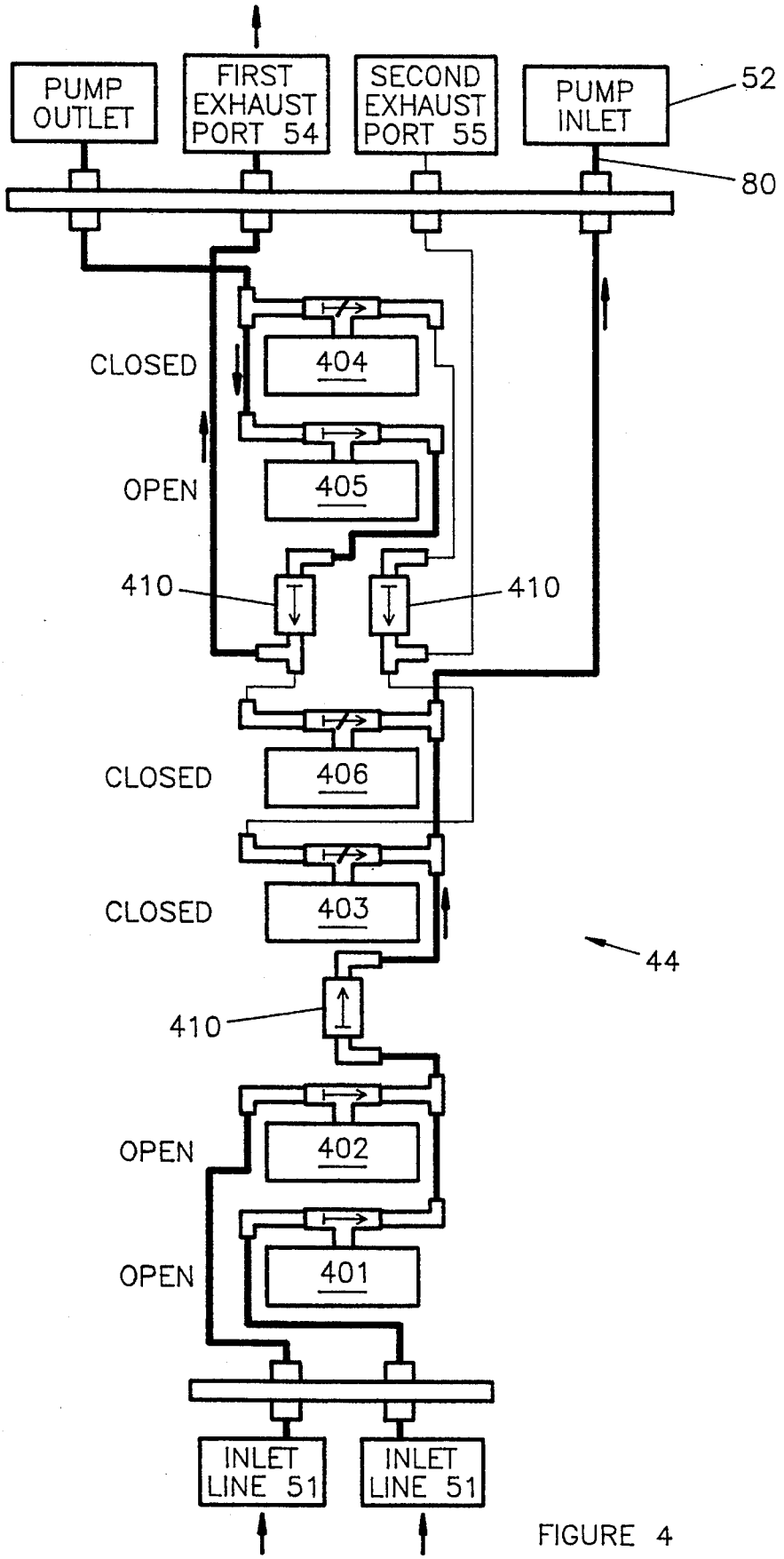
FIG. 4 is a schematic of an embodiment of the exhaust direction means illustrating the second operational function or the first directional function.

The exhaust direction means 44 needs a minimum capability as defined by four one-way valves for a pump means having a tubular inlet and for a single inlet line. Valve capability corresponding to five one-way valves is needed for pump means having a flooded inlet. With valve capability defined by four or five one-way valves, five basic operational functions are provided with a single inlet line 51. Additional valve capability as defined by a one-way valve is needed for each additional inlet line 51. FIG. 4 is a schematic of one-way solenoid valves with two inlet lines 51. Inlet valve 401 is for one of the inlet lines, and inlet valve 402 is for the other inlet line. Exhaust valve 403 is used in combination with purge valve 405 for purging exhaust port 55 by emptying the well fluid contents therein into the first exhaust port 54. Sample valve 404 for collecting well fluid samples from the lower annulus 16 and directing them to the second exhaust port 55. Purge valve 405 is for purging the lower annulus 16 by removing well fluid to the first exhaust port 54. Extraction valve 406 is used only with sample valve 404 for removing well fluid from above the packer 24 to the second exhaust port 55 that may terminate above the top of the well.

The first operational function is no flow for storage or installation of the isolation assembly 6.

The second operational function is removal of well fluid from the lower annulus 16 through inlet line(s) via pump means 42 and thence to the first exhaust port 54. This direction function is referred to as purge or purging. Again, with reference to FIG. 4, the valves are arranged to accomplish a purge of the lower annulus Sample valves 401 and 402 are open while valves 403, 404, and 406 are closed. Well fluid is drawn through samples valves 401 and 402 to the pump inlet 52. The pump exhausts the well fluid through open purge valve 405 to the first exhaust port 54.

Figure 5:
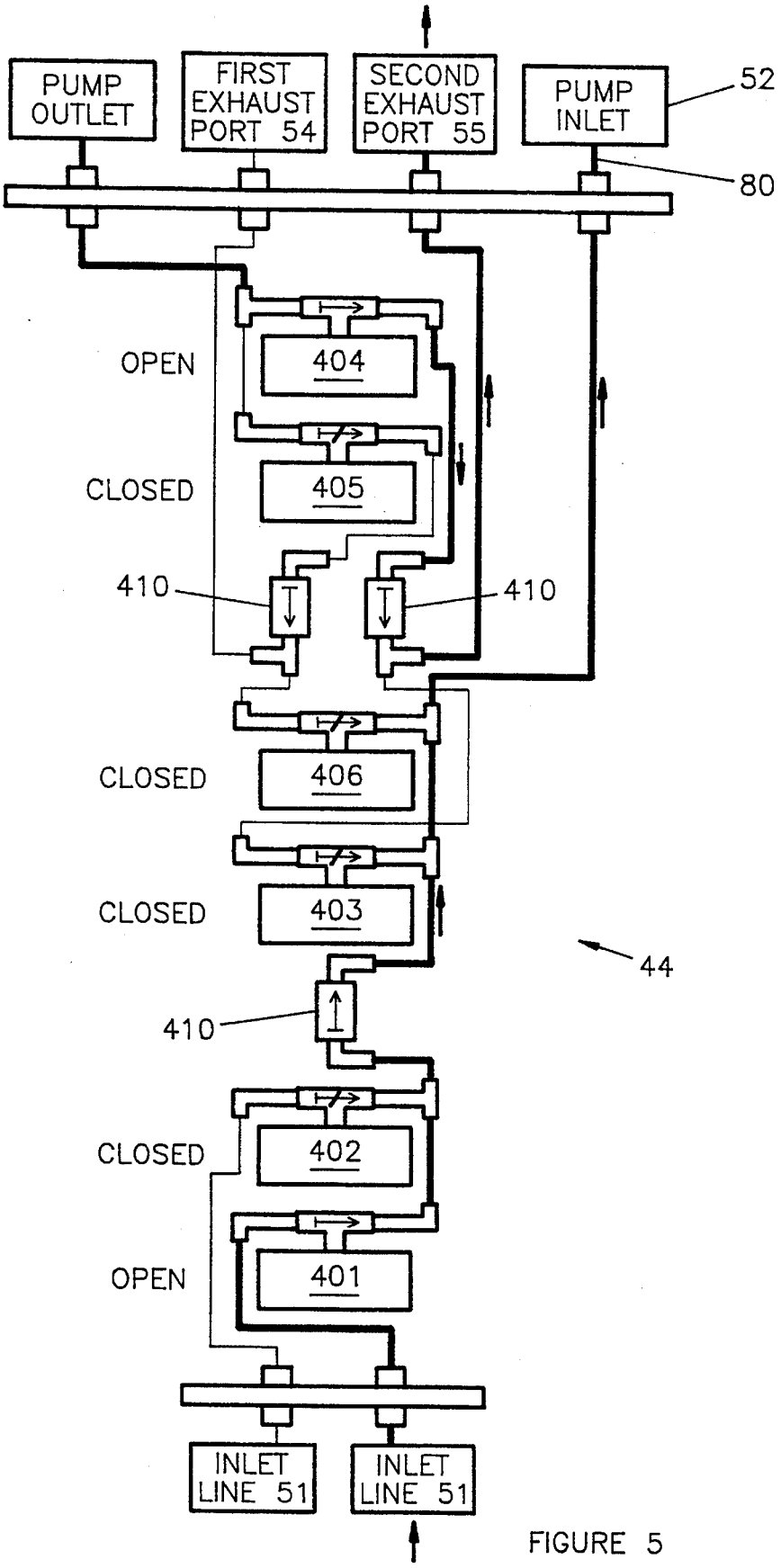
FIG. 5 is a schematic of an embodiment of the exhaust direction means illustrating the third operational function.

The third operational function, sample collection is shown in FIG. 5. While mixed samples from multiple sample lines 51 is permissible, a single sample line sampling is illustrated. Sample valve 401 is open to receive a sample of well fluid from the lower annulus 16. The sample is drawn past sensor(s) 80 upstream of the pump inlet The pump discharges through sample valve 404 to the second exhaust port 55. The purpose of discharging to the second exhaust port 55 is so that additional analyses may be done either for confirmation of sensor(s) 80 or complimentarily to information provided by sensor(s) 80. Valves 402, 403, 405, and 406 remain closed during sample collection.

Figure 6:
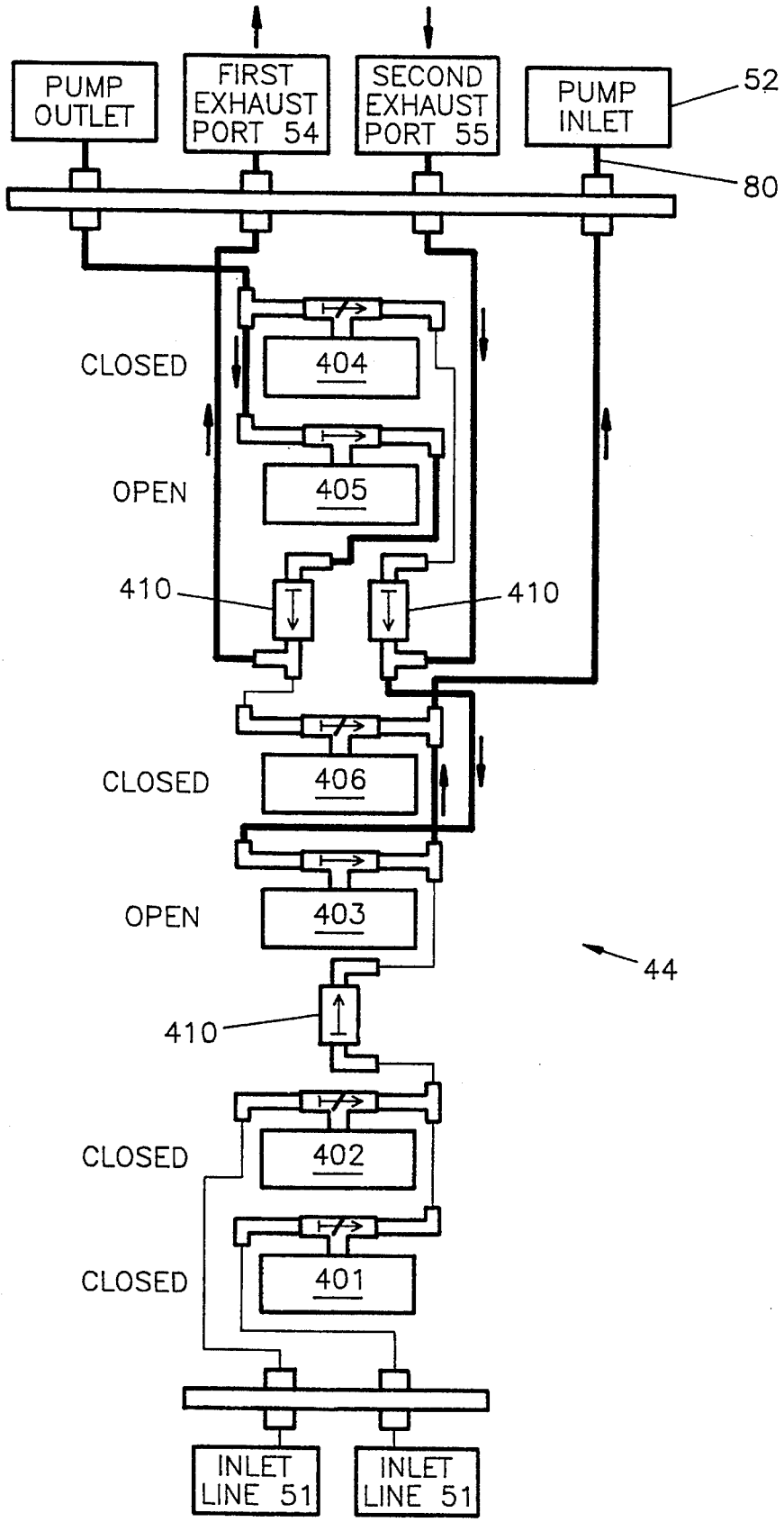
FIG. 6 is a schematic of an embodiment of the exhaust direction means illustrating the first direction function.

The fourth operational function, sample tube purge, requires two direction functions. The purpose of this operational function is to remove well fluid remaining in the second exhaust port 55 and in the inlet line(s) from previous sampling activity in preparation for obtaining new fresh sample(s). The first direction function is illustrated in FIG. 6 wherein well fluid is drawn from the second exhaust port 55 through exhaust valve 403 to the pump inlet 52. The second direction function is a purge of the inlet line(s) 51 according to the second operational function as described above. The reason that separate purging of the second exhaust port 55 and of the inlet line(s) 51 is provided is for pump means 42 that have an open or flooded inlet. Pump means 42 having a closed or tubular inlet would permit a single purge of inlet and exhaust lines.

Figure 7:
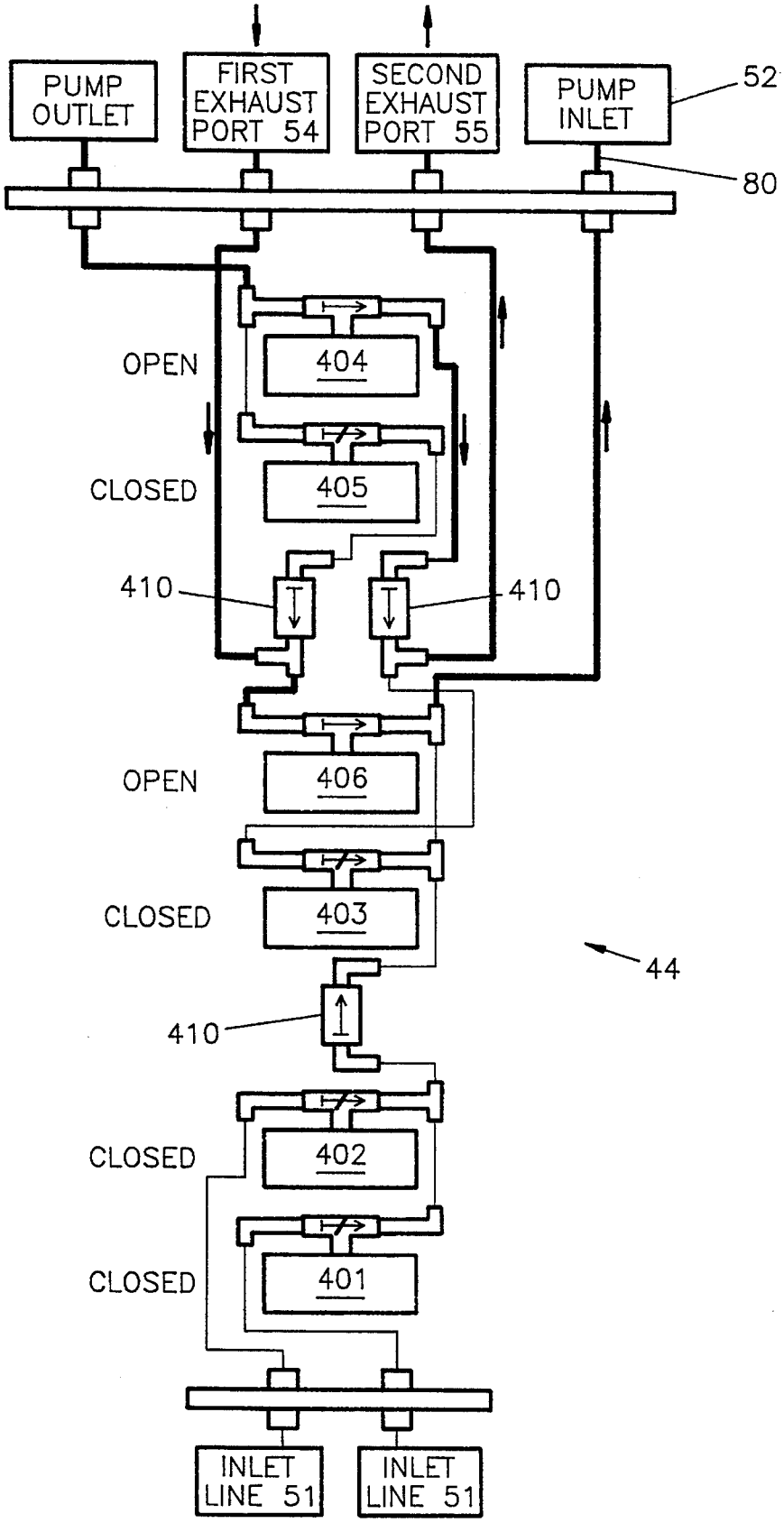
FIG. 7 is a schematic of an embodiment of the exhaust direction means illustrating the fifth operational function.

The fifth operational function is removal of well fluid from above the packer 24 to above the well, or purged well fluid extraction. If purged well fluid is stored within a riser, then the option exists for simply closing the riser and removing it from the well, or removing riser and isolation assembly 6 then closing the riser and separating it from the isolation assembly 6. If, on the other hand, purged well fluid is stored in the well above the packer 24, then purged well fluid may be removed as illustrated in FIG. 7. Well fluid is drawn from the first exhaust port 54 through extraction valve 406 to the pump inlet 52. The pump exhausts through sample valve 404 to the second exhaust port 55 and thence to the top of the well.

RETROFIT ISOLATION ASSEMBLY

Figure 8:
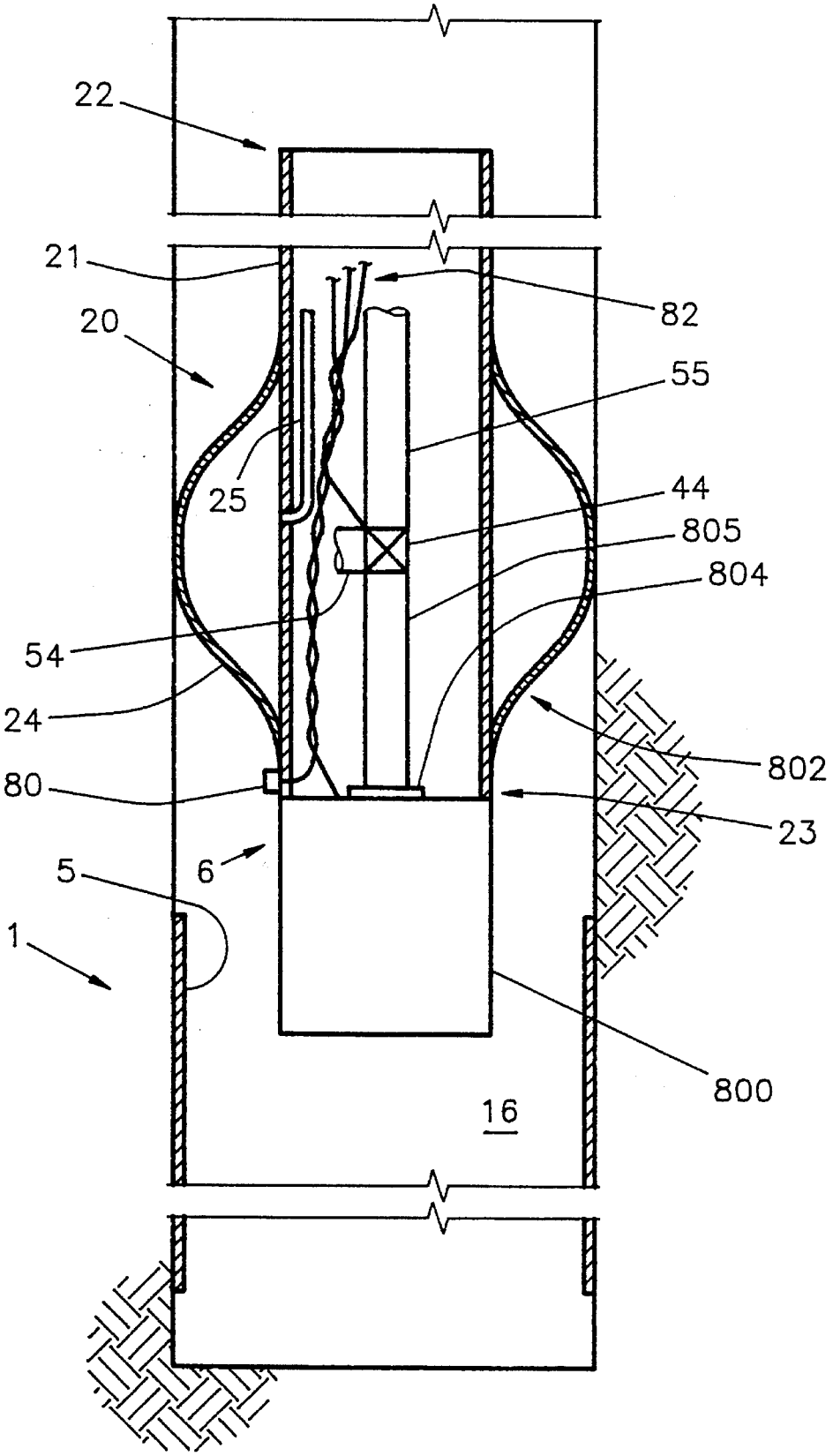
FIG. 8 is a section view of a retrofit isolation assembly.

For applications in which it is desirable to utilize a pumping means that may already be present in the well 1, the isolation assembly 6 may be simplified as depicted in FIG. 8. In these applications, the isolation assembly 6 is made up of existing pump means 800 and an assembly kit 802.

The existing pump means 800 may be any type of pump means, but is preferably a centrifugal pump means so that well fluid may drain through the pump means when it is not operating. If existing pump means 800 is a type of pump that does not so drain, an additional valve in the exhaust direction means 44 may be needed.

The assembly kit 802 has a packer unit 20 and an exhaust direction means 44. The packer unit may be of any type, but is preferably an inflatable packer 24 as shown in FIG. 8. The inflatable packer 24 is mounted on packer housing 21. The exhaust direction means 44 has the equivalent of two one-way valves, preferably a three-way valve, plus directional plumbing through which well fluid is received from pump exhaust 804, then directed either to the first exhaust port 54 emptying either into a riser or directly into the well space above the packer, or to the second exhaust port 55 emptying to the top of the well 1.

The packer housing 21 has an open end 22 and a coupling end 23. Coupling may be to a pump means 800 as shown in FIG. 8 or to the discharge pipe 805. It will be appreciated by those skilled in the art of well sampling that many sealable couplings are useable for this purpose.

The three-way valve may be any type of three-way valve, but is preferably an electrically actuated three-way valve. In combustible environments, the three-way valve may be pneumatically or hydraulically actuated.

In certain wells, the bottom 3 may be much below an active portion 5 from which samples are desired. In these wells, the isolation assembly 6 may have a second packer 24 mounted on the isolation unit 70, or in the case of a retrofit, a second packer assembly 20 would be added below the pump means 800. A valve means 10 would be needed at the bottom of either the isolation unit 70 or the second packer assembly 20. In this case, the valve means 10 would be actuated by means other than by contact with the bottom of the well.

The isolation assembly has two basic operational functions. The first operational function is purging wherein well fluid is taken from the lower annulus 16 and discharged through the first exhaust port 54. The second operational function is sampling wherein well fluid from the lower annulus 16 is discharged through the second exhaust port 55. As an option, sensor(s) 80 may be placed on or below the packer housing 21.

A yet further embodiment is an isolation assembly 6 having simply a packer unit 20 sealably attached to a pump means 800 or a pump discharge pipe 805. In this embodiment, the second exhaust port 55 would go to the top of the well and terminate with a flexible pipe or hose, while the first exhaust port 54 is absent. In this case, the flexible pipe or hose is the exhaust direction means 44 but having no valves per se. Flexible pipe includes but is not limited to jointed hard pipe, or bendable plastic, or composite material pipe or hose. For purging, the flexible pipe or hose is placed in the well bore and well fluid is collected above the packer 24. For sampling, the flexible pipe or hose is directed to a sample collection container. This embodiment is not preferred because additional purge volume is required to ensure purging of the exhaust port 55 volume.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. An isolation assembly for obtaining well fluid from a well having a top opening, a bottom, an inner surface, and an active portion, wherein the isolation assembly comprises:

(a) an isolation unit having a housing that is hollow defining an isolation chamber, and insertable into the well, the isolation chamber further having a first end positioned within the active portion of the well and a second end extending above the active portion of the well;

(b) valve means for admitting a portion of the well fluid into the isolation chamber, said valve means mounted on or near the first end, said valve means also for sealing the portion of the well fluid within the isolation chamber, thereby preventing mixing of well fluid within the isolation chamber with well fluid in an annular space between the isolation chamber and an inner surface of the well;

(c) sealing means for sealing the annular space, said sealing means mounted near the second end and positioned above the active portion, thereby isolating well fluid in a lower annulus from below said sealing means to the bottom of the well from well fluid above said sealing means;

(d) means for obtaining well fluid from the lower annulus into an inlet; and (e) a pump means for pumping obtained well fluid from the inlet to an exhaust port.

2. The isolation assembly as recited in claim 1, wherein obtaining well fluid is purging or sampling the well fluid.

3. The isolation assembly as recited in claim 1, further comprising:

(f) sensing means for characterizing the obtained well fluid.

4. The isolation assembly as recited in claim 1, further comprising:

(g) an exhaust direction means permitting selection of an operational function with selected flow paths.

5. The isolation assembly as recited in claim 4, wherein said pump means and said exhaust direction means are mounted in a housing forming an operational unit.

6. The isolation assembly as recited in claim 1, wherein said sealing means comprises:

(h) a packer unit.

7. The isolation assembly as recited in claim 6, wherein said packer unit comprises:

(i) a housing with an open end and a coupling end;

(j) a packer mounted on the housing; and (k) a packer inflation tube for pressurizing the packer.

8. The isolation assembly as recited in claim 1, further comprising:

(l) an exhaust direction means permitting selection of an operational function with selected flow paths;

(m) an operational unit having a housing in which are mounted said pump means and said exhaust direction means; and (n) said sealing means comprising a packer unit having a packer housing with an open end and a coupling end, with a packer mounted on the packer housing.

9. The isolation assembly as recited in claim 8, further comprising:

(o) a spacer unit placed between and connected to the packer unit and the operational unit; and (p) an isolation unit with means for admitting well fluid mounted therein, and having said valve means.

10. A method for obtaining well fluid from a well having a top opening, a bottom, an inner surface, and an active portion, wherein the method comprises the steps of:

(a) inserting an isolation unit having a housing defining an isolation chamber that is hollow and has a first end and a second end, and positioning the first end within the active portion of the well and extending the second end above the active portion of the well;

(b) admitting a portion of the well fluid into the isolation chamber and sealing the portion of the well fluid within the isolation chamber, thereby preventing mixing of well fluid within the isolation chamber with well fluid in an annular space between the isolation chamber and an inner surface of the well;

(c) sealing the annular space with a sealing means near the second end and above the active portion, thereby isolating well fluid in a lower annulus from below the sealing means to the bottom of the well from well fluid above said sealing means;

(d) obtaining well fluid from the lower annulus into an inlet through at least one port mounted on the isolation chamber; and (e) pumping obtained well fluid from the inlet to an exhaust port.

11. The method as recited in claim 10, wherein obtaining well fluid is purging or sampling the well fluid.

12. The method as recited in claim 10, further comprising:

(f) sensing at least one characteristic of the obtained well fluid.

13. The method as recited in claim 10, further comprising:

(g) selecting an operational function with an exhaust direction means permitting selection of flow paths.

* * * * *

UNITED STATES PATENT AND TRADEMARK OFFICE

CERTIFICATE OF CORRECTION

PATENT NO. : 5,460,224
DATED : 10/24/95
INVENTOR(S) : Schalla et al.

It is certified that error appears in the above-indentified patent and that said Letters Patent is hereby corrected as shown below:

In column 3, line 63, after the word "unit" please insert the reference number --30--.

In column 4, line 67, after the word "sensors" please insert --80.--.

In column 5, line 17, after the word "hole" please insert the number --312--.

In column 5, line 18, after the phrase "a center hole" please insert --313--.

In column 5, line23, after the phrase "Below the bulkhead disk" insert --311--.

In column 5, line 41, please replace "75" with --71--.

In column 6, line 34, after the word "line(s)" please insert --51--.

In column 6, line 38, after the word "annulus" please insert --16.--.

In column 6, line 48, after the word "inlet" please insert --52.--.

In column 6, line 58, after the word "line(s)" please insert --51--.

Signed and Sealed this

Second Day of September, 1997

*Attest:*

Bruce Lehman

BRUCE LEHMAN

*Attesting Officer*

*Commissioner of Patents and Trademarks*